US005605184A

United States Patent [19]

Nordin et al.

[11] Patent Number: 5,605,184

[45] Date of Patent: Feb. 25, 1997

[54] APPARATUS FOR DEBARKING LOGS INDIVIDUALLY

[76] Inventors: Ulf Nordin, Mazurkavägen 4; Lennart Börjesson, Rud; Roland Eriksson, Södra Bryggerivägen 36, all of S-663 02 Hammarö, Sweden

[21] Appl. No.: 530,280

[22] PCT Filed: Feb. 28, 1994

[86] PCT No.: PCT/SE94/00161

§ 371 Date: Sep. 1, 1995

§ 102(e) Date: Sep. 1, 1995

[87] PCT Pub. No.: WO94/20272

PCT Pub. Date: Sep. 15, 1994

[30] Foreign Application Priority Data

Mar. 5, 1993 [SE] Sweden ..... 9300763

[51] Int. Cl.[6] ..... B27L 3/00; B27L 1/14

[52] U.S. Cl. ..... 144/208.3; 144/340

[58] Field of Search ..... 144/208.1, 208.3, 144/340

[56] References Cited

U.S. PATENT DOCUMENTS

| | | | |
|---|---|---|---|
| 3,942,565 | 3/1976 | Ratelle et al. | 144/208.3 |
| 4,047,549 | 9/1977 | Ratelle et al. | 144/208.3 |
| 4,609,021 | 9/1986 | Bengtsson | 144/208.3 |
| 4,640,327 | 2/1987 | Krilov | 144/340 |

FOREIGN PATENT DOCUMENTS

| | | | |
|---|---|---|---|
| 490180 | 2/1977 | Australia | 144/208 D |
| 527964 | 7/1956 | Canada | 144/208 D |
| 131040 | 3/1951 | Sweden . | |
| 145115 | 5/1954 | Sweden . | |
| 460406 | 10/1989 | Sweden . | |
| 91008540 | 9/1992 | Sweden . | |

*Primary Examiner*—W. Donald Bray

*Attorney, Agent, or Firm*—Michael D. Bednarek; Kilpatrick & Cody

[57] ABSTRACT

The invention relates to an apparatus for debarking logs individually with the aid of high-pressure water jets. The spray nozzles are intended to spray water in focused jets against the log at the same time as the log moves past the spray nozzles. The invention is characterized by a ring (22) through which the log is intended to be fed, in that units (42, 46, 46') are mounted on the inside of the ring, uniformly distributed about the periphery of the said ring, which units are intended to bear against the surface of the log passing through the ring, in that a spray nozzle (40) is arranged in each such unit, which spray nozzle is made to maintain an essentially constant distance from the surface of the log by means of the fact that the unit bears against the surface of the log, this distance lying within a range of distance from the surface of the log which is optimal for debarking. In addition, suitable means are intended to turn the ring in an oscillating manner to and from about the centre axis of the ring during debarking.

16 Claims, 3 Drawing Sheets

APPARATUS FOR DEBARKING LOGS INDIVIDUALLY

TECHNICAL FIELD

The invention relates to an apparatus for debarking logs individually with the aid of high-pressure water jets, the apparatus comprising a number of spray nozzles intended to spray water in focused jets onto the log at the same time as the log moves past the spray nozzles.

PRIOR ART

Before cutting up the raw materials of wood in saw mills and the pulp industry, it is necessary to remove the bark from the logs. Two methods are mainly used for this purpose, these methods having their origins around the periods when these respective industries came into being.

Saw mills mainly use so-called Cambio debarking in which the bark is peeled off with the aid of knives which rotate around the log in an annular holder. This method leaves some of the bark remaining on the tree-trunk and is in addition energy-intensive and noisy. The equipment also requires careful servicing.

The pulp industry uses debarking drums with diameters of 3–6 m and lengths of up to 35 m. The drum lies at a slight incline, mounted on pulley brackets and is set in rotation by drive machinery. The logs are fed in at the upper end, and, as a result of the rotation and inclination of the drum, the logs are conveyed through the drum and eventually issue at the other end. The debarking is achieved by means of the logs scraping and striking against the walls of the drum and against other logs in the drum. A virtually one hundred percent debarking result is sought so as to ensure that residual bark does not impair the quality of the paper. This means that the dwell time in the debarking drum is determined by the logs which are most difficult to debark. This in turn means that most of the logs have too long a dwell time in the drum, which leads unnecessarily to a high energy expenditure. In the debarking drums the logs are sprayed continuously with water, which is required as "lubrication". Water is also used as a means for conveying the bark which has been peeled off. These large amounts of water have to be dealt with and cleaned at a later stage. This debarking method thus uses up large amounts of energy and water, and at the same time the debarking equipment is expensive and takes up a great deal of space.

Debarking with high-pressure water has also been proposed. As early as 1912 a Swedish patent 35392 was published relating to a method for debarking wood, in which "the wood is made to execute a spiralling movement past a pressure-medium jet, where appropriate provided with solid particles".

An American patent U.S. Pat. No. 2,463,084 from 1949 relates to debarking with high-velocity jets, in which the unit which comprises the spray nozzles moves around the log, so that the debarking is executed in a spiral as the log moves through the rotating instrument.

Another American patent U.S. Pat. No. 2,473,461 stresses the importance of the jets being directed radially with respect to the axis of the log at all times, regardless of the size and shape of the log, and of the spray nozzles being located at a predetermined optimal distance from the surface of the log. However, the apparatus which is described in the patent specification cannot satisfy the stated conditions in practice and it is additionally complicated and, in quite general terms, functionally unreliable.

The principle of using high-pressure water for debarking logs has therefore not as yet been applied in practice.

BRIEF DISCLOSURE OF THE INVENTION

The present invention has the object of providing an improved apparatus of the type which is mentioned in the introduction above. A particular object of the invention is to offer an apparatus for debarking logs individually with high pressure water which is sprayed against the log, requiring considerably less water, energy, space and maintenance compared with the abovementioned debarking apparatuses which are generally used in the forest industry at present.

The present invention also aims to offer a debarking apparatus in which the spray nozzle is held essentially within an optimal range of distance from the surface of the log, so that the focused jet cuts through the layer of bark, after which the jets of water are broken up on the wood lying within the bark, the said bark shattering and falling off.

These and other objects of the invention can be achieved by virtue of the fact that the invention is characterized by what emerges from the patent claims which follow.

Further characteristics and aspects of the invention emerge from the following description of a preferred embodiment.

BRIEF DESCRIPTION OF THE FIGURES

In the following description of a preferred embodiment reference will be made to the attached drawings in which.

DESCRIPTION OF A PREFERRED EMBODIMENT

Figure 1:
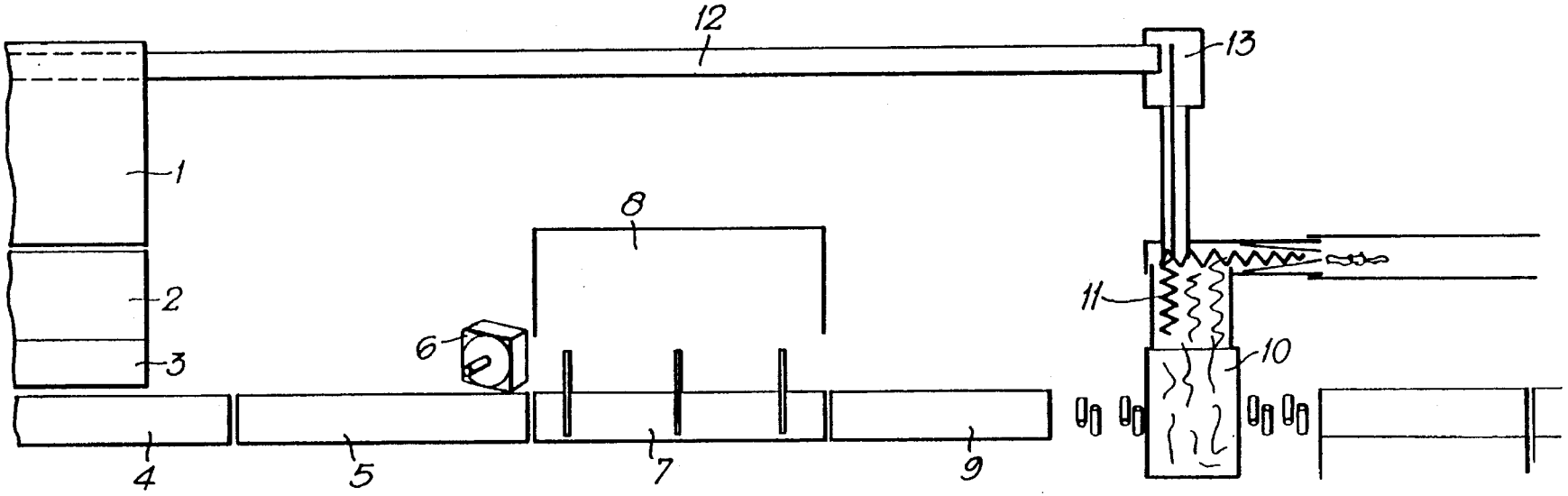
FIG. 1 shows diagrammatically a debarking station in which the apparatus according to the invention can be used.

FIG. 1 shows diagrammatically a plant in which the apparatus according to the invention is included. In the plant the logs first come to a receiving hopper 1, in which the logs are laid on top of one another. In the receiving hopper 1 a preliminary debarking takes place as a result of the logs lying and scraping against one another. From the receiving hopper 1 the logs are advanced on a rolling deck 2, after which a single-log feeder 3 feeds the logs out one by one onto a conveyor 4 which leads to an apparatus 5 for measuring and identifying one log at a time, in which apparatus 5 a computerized measurement system 6, which can be of a type known per se and is coupled to a process monitor, optically measures the diameter and straightness of the log which is due to be measured. According to an alternative of the preferred embodiment the measurement can also be performed with the aid of laser or ultrasound in accordance with known techniques. The presence of protruding knots is also revealed during measurement. Finally, the measurement system 6 classifies the roughness of the bark. When the measurement in the system 6 has been completed, the log advances to the conveyor 7 where logs which have been found by the measurement system 6 to be too crooked, or to have too great a diameter, or to have protruding knots, are removed from the conveyor and are thrown down into a hopper 8. These logs are later used for other purposes. The remaining logs are moved via a belt conveyor 9 to a debarking apparatus 10 according to the invention, where the logs are debarked one by one.

The bark stripped in the debarking apparatus 10 is conveyed to a bark compressor 11, to which bark also arrives on a conveyor belt 12 from the receiving hopper 1, the bark having been treated in a shredder 13 in order to obtain the correct piece thickness.

The debarked log is then conveyed onwards into a forest industry processing plant for the production of pulp or saw mill products.

Figure 2:
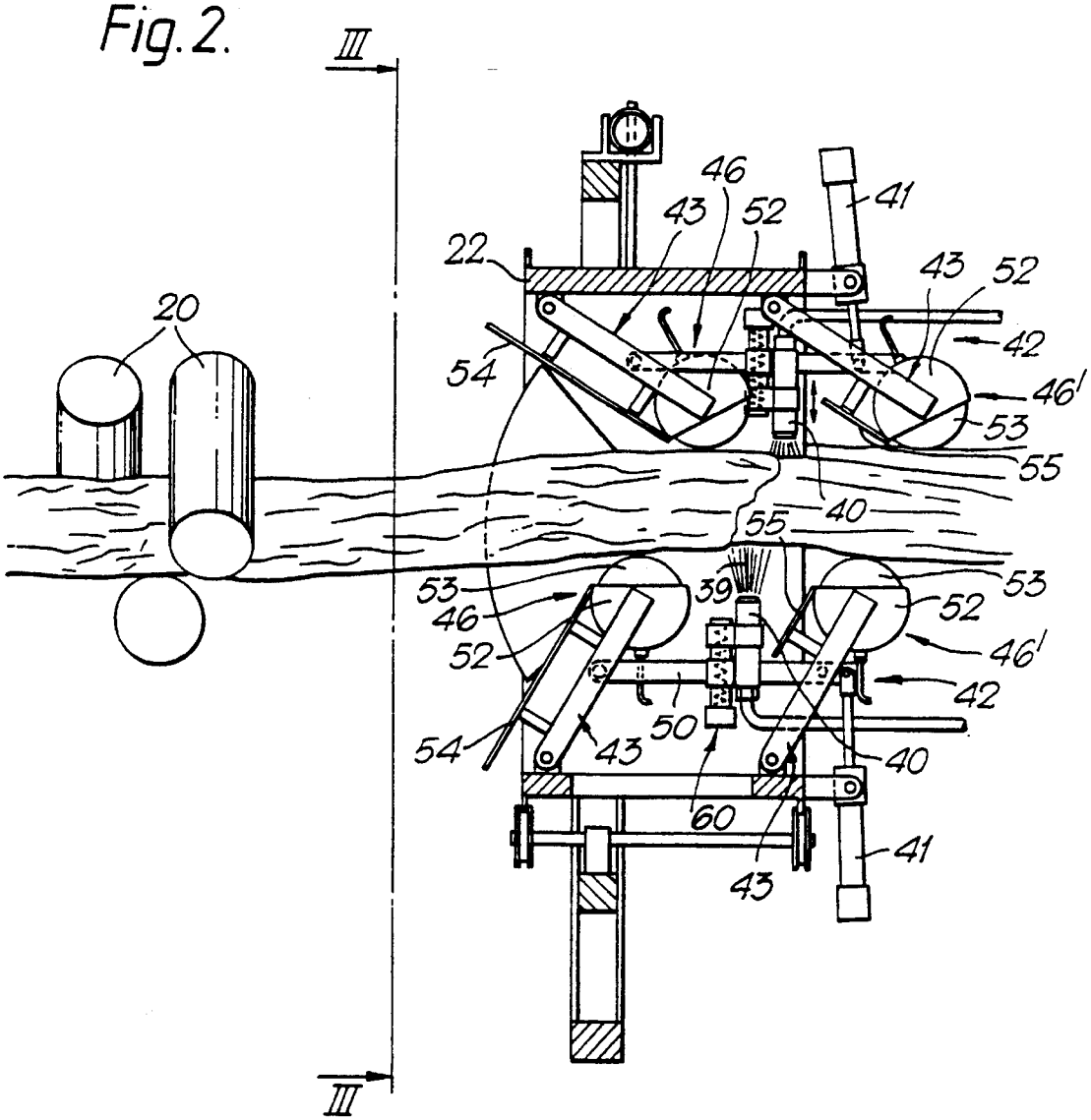
FIG. 2 shows the debarking apparatus in longitudinal section, with two spray nozzles and a log in the process of being debarked.
Figure 4:
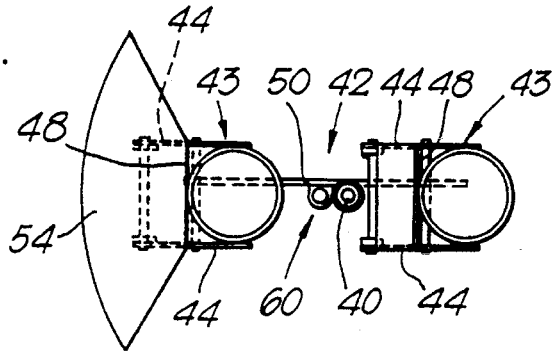
FIG. 4 shows a bottom view of a component of the debarking apparatus for holding and positioning a spray nozzle.
Figure 3:
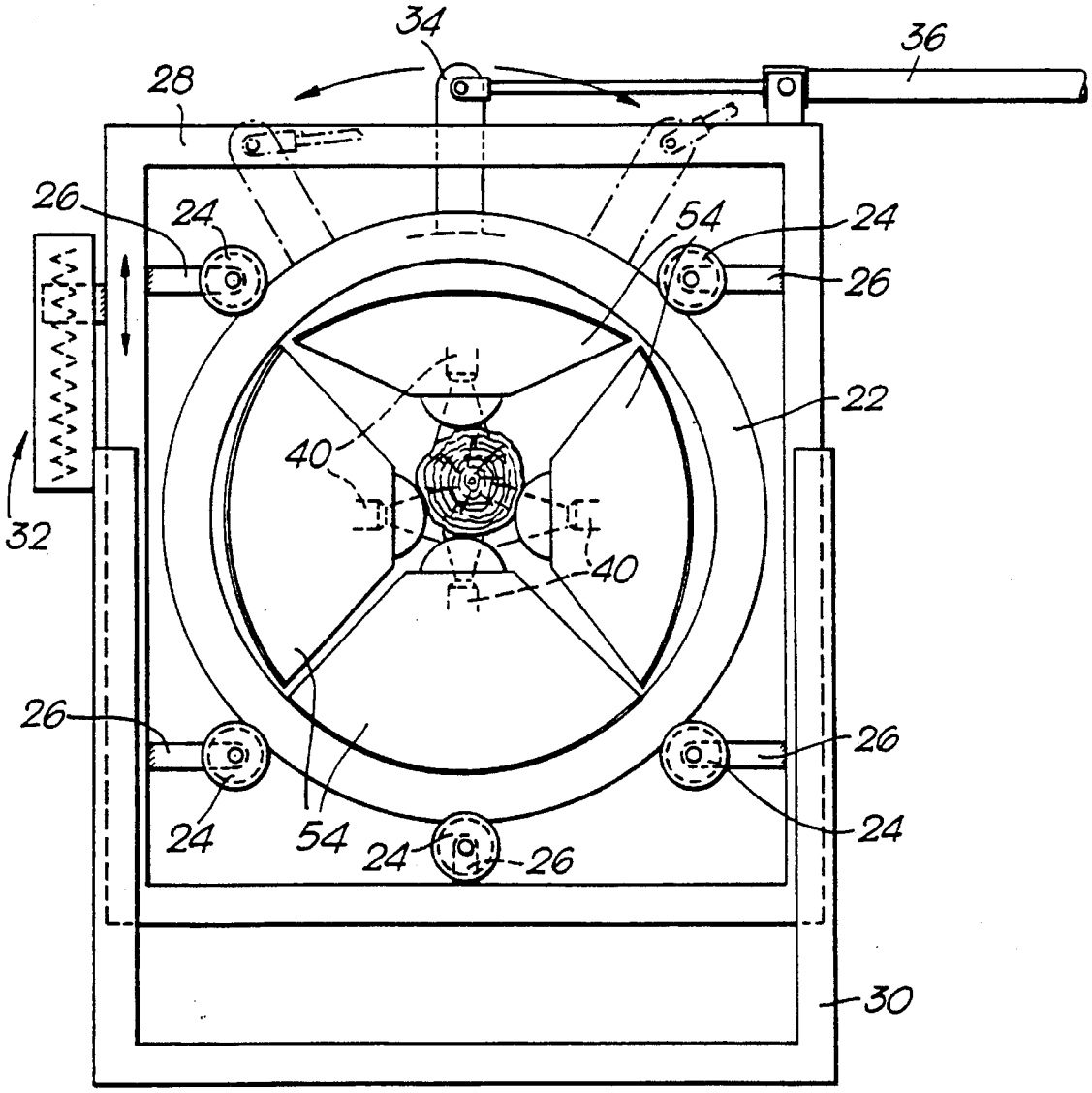
FIG. 3 shows the debarking apparatus in a front view along III—III.

FIGS. 2 and 3 show the structure and function of the debarking apparatus 10. The log approved for debarking leaves the conveyor belt 9 and is moved onwards with the aid of feeding mechanisms 20 into the debarking apparatus. The feeding mechanisms 20 can consist of feeding mechanisms of the "Cambio" type in accordance with known techniques, the feeding mechanism 20 preferably being used in pairs (not shown) so that one pair is located on the inlet side of the debarking apparatus and one pair is located on its outlet side, the log being fixed the whole time in the longitudinal direction.

The debarking apparatus 10 comprises a ring 22 suspended on five wheels 24 which are distributed about the periphery of the ring 22 and allow the ring to be turned about its centre axis. Each one of the wheels 24 is located on a projection 26, these projections being connected to a frame. The frame 28 can be raised and lowered by means of a hoist device 32 in an outer frame or guide 30 which is formed by a U-shaped profile. The purpose of the hoist device 32 is to raise or lower the debarking apparatus 10, on the basis of information relating to the diameter of the log, so that the centre line of the log coincides closely with the centre line of the ring 22. According to an alternative of this embodiment the centre lines of the log and of the ring can be made to coincide closely by virtue of the fact that the abovementioned feeding mechanisms 20 can be raised or lowered in relation to the debarking apparatus 10. At the top of the ring 22 a lever 34 projects at right angles from the ring 22. At its upper end the lever 34 is connected rotatably to a hydraulic cylinder 36. With the aid of the hydraulic cylinder 36 the ring can be made to rotate in an oscillating manner about its centre line.

Four high-pressure nozzles are arranged on the inside of the ring 22, each one mounted on an articulated parallelogram 42 which, by turning at the four points of articulation, can move inside the ring in a radial plane with respect to the latter. Each one of the four articulated parallelograms 42 comprises two parallel pairs 43 of mutually parallel bars 44. At their ends the pairs of bars or the arms 43 are rotatably connected to projections on the inside of the ring 22. Between the bars 44 in each pair of bars or arm 43 there is a transverse bar 48. Extending between these transverse bars 48 is a longitudinal bar 50 which is connected rotatably at both its ends to the transverse bars 48. The longitudinal bar 50 is parallel with an imaginary line between the projections on the inside of the ring 22 in the said radial plane of the parallelogram and forms, together with the said line, the third and fourth arms in the articulated parallelogram 42. Thus, in all the positions which can obtain by inclining the two parallel pairs of bars or the arms 43, the longitudinal bar 50 is parallel with the centre line of the ring 22.

The high-pressure nozzles 40 are mounted on the longitudinal bars 50 in the articulated parallelograms 42, there being located on each such longitudinal bar 50 a high-pressure nozzle 40 directed radially towards the centre line of the ring 22. Each one of the nozzles 40 is located on an adjustment device 60 by means of which the distance of the nozzle from the surface of the log can be adjusted, independently of the setting of the articulated parallelogram 42, but, rather, on the basis of information such as variety of tree, time of year and the like.

The parallel pairs of bars or the arms 43 are each connected at their respective inner ends to a follower 46, 46' which, during debarking, is intended mainly to follow the surface of the log by rolling or sliding on the latter, so that the articulated parallelogram moves in its radial plane by turning at its four points of articulation. In this way the longitudinal bar 50, on which the high-pressure nozzle 40 is mounted, is at all times held at a substantially constant distance from the surface of the log. This in turn ensures that the high-pressure nozzles 40 are at all times located within a range of distance from the surface of the log which is essentially optimal for debarking, since the position of the nozzle 40 relative to the longitudinal bar 50 has been set, as has been mentioned above, with respect to the actual parameters of the type of wood.

Located at the inlet side of the debarking apparatus, on each pair of bars or arms 43 parallel to the inlet side, is a first protective plate 54 which is formed essentially as a quarter circle and which extends almost from the periphery of the log almost to the inside of the ring. Furthermore, a second protective plate 55 is additionally located at the outlet side of the debarking apparatus, on each one of the arms/pairs of bars 43 and to the inside of the second follower 46', this second protective plate 55 extending outwards a relatively short distance almost from the periphery of the log.

The followers 46, 46' consist of a hemispherically shaped hollow holder 52, in which holder 52 a ball 53 sits which can rotate freely in all directions. The followers 46, 46' have an attachment for rinse water, which water is intended to prevent dirt from penetrating between the ball 53 and the holder 52 by constantly rinsing this intermediate space. In this way a lubrication of the ball 53 is also achieved.

The articulated parallelograms 42 thus follow the contour of the log individually, that is to say they assume positions which are determined by the diameter of the log, its curvatures and any small projecting knots on the log, by being pushed away or springing back, by means of their rotating at the four corners of the parallelogram, as emerges from FIG. 2. Each articulated parallelogram 42 is also equipped, for this purpose, with a spring-mounted hydraulic cylinder 41 which ensures that at least one of the followers 46, 46' bears at all times against the surface of the log. It is normally the follower 46 located nearest the inlet which bears against the log during the greater part of the debarking process, while the follower 46' located nearest the outlet additionally has the purpose of preventing the nozzle 40 from falling down onto the log when the rear end of the log has passed the follower 46 located nearest the inlet. According to one alternative of this embodiment, at least the follower 46' can also be designed as a slay which follows the surface of the log by sliding thereon.

In order to ensure that the jet 39 of medium will be able to act on the whole surface of the log, the jet 39, which has an active area of a few $cm^2$, is moved over the surface of the log. This is achieved by using a rotating apparatus in accordance with known techniques, in which a nozzle 40 is equipped with one or more mouthpieces at a slight angle, which nozzle 40 is set in rotation by the water which flows through it. In this way the stripping surface is increased to 1–2 $dm^2$. In order for the log to be stripped round the whole periphery, it is necessary for one or more nozzles 40 to rotate round the log or for the log to rotate with respect to the nozzle 40.

According to the present embodiment of the invention, there are four uniformly distributed nozzles. These nozzles 40 are mounted in the annular stand 22 which is rotated to and fro inside the wheels 24 with the aid of the hydraulic cylinder 36 while the log is being fed through the ring 22, these nozzles 40 thus being able to act on the surface of the log within their respective sectors.

After the log has passed the station 5 and the measurement system 6, the operating parameters of the debarking apparatus 10 are adapted to the diameter of the log and the outer structure of the bark. The operating parameters are also affected by pre-set basic conditions such as variety of tree, storage period, preliminary treatment and time of year. All these basic conditions dictate how loosely or how firmly the bark lies on the log, and they also affect the thickness of the bark. A further basic operating parameter is the subsequent use of the debarked log. If the log is to be used for the production of light mechanical wood pulp, all the bark must basically be removed. If, on the other hand, the log is to be sawn, the requirements for clean debarking of the log are less.

The term intensity here refers to the period during which an arbitrary point on the surface of the log is acted upon by jets 39 of medium and to the prevailing pressure of the medium. The intensity of the debarking operation is set on the basis of the following variables, which are in this case the pressure of the jets 39 of medium, the distance of the nozzle 40 from the surface of the log, the speed of the log in the longitudinal direction relative to the nozzle 40, and the to and fro movement of the nozzles 40.

These variables have values in the following ranges:

| | |
|---|---|
| Pressure of jet of medium | 350–800 bar |
| Distance of nozzle from surface of log | 50–150 mm |
| Speed of log in longitudinal direction | 0.1–1 m/s |
| Rotation of nozzle about log (to and fro movement corresponding to a rotational speed of | 30–200 rpm |

In order to facilitate the introduction of the log into the spray zone of the debarking apparatus, the parallelogram moves out to a standby position at the periphery between each log. As a result the debarking apparatus 10 is fully open when the log arrives, and the log does not have to act on the protective plates 54 and on the followers 46 in order to force itself into the spray zone of the debarking apparatus. A photocell (not shown) indicates when the log arrives, and the photocell emits an impulse, whereupon the hydraulic cylinders allow the followers 46 to drop. The impulse travels via the processor, in which account is taken of the speed of the log in the longitudinal direction, this speed having been determined upon earlier measurement of the log, and the followers 46 always drop and land on the surface of the log immediately behind its front end. When the rear end of the log passes the photocell, an impulse is emitted to the processor to the effect that the parallelograms 42 are to return to the standby position at the periphery after a certain period of time which is determined by the speed of the log in the same way as above, the followers 46' leaving the surface of the log immediately in front of its rear end. By means of this procedure the equipment is saved from jolts and fatiguing stresses, and at the same time fewer demands need be placed on the feeding mechanism due to the fact that the latter does not have to force the log into the spray zone.

When the log arrives in the spray zone of the debarking apparatus 10, the medium is sprayed onto the log at a pressure, and at a distance between the nozzles 40 and the surface of the log, which is such that the focused jet cuts through the layer of bark, after which the jets of water break up against the wood lying within the bark, the bark shattering and falling off. It is of the utmost importance that the log 40 is at the correct distance from the surface of the log and that the jet has the correct kinetic energy. If the nozzle 40 lies too near the log, the kinetic energy of the focused jet is too great, the result of which is that the jet penetrates past the bark, and the wood is also shattered. If, on the other hand, the nozzle 40 lies too far from the surface of the log, at a distance beyond the reach of the focused jet, the kinetic energy of the jet will essentially be lost and the jet will break up in the air. The optimal distance is set with the aid of the adjustment device 60, which distance is kept essentially constant by means of the movements of the articulated parallelogram in the radial plane.

We claim:

1. An apparatus for debarking a log passed therethrough, comprising:

a ring member having a central axis and through which the log is passed; and a plurality of spray units mounted on said ring member, wherein each spray unit comprises:

an articulated frame including:

first and second pairs of parallel arms, each arm of said first and second pairs of parallel arms being pivotably connected at respective first ends thereof to said ring member; and an intermediate arm pivotably interconnected with both said first and second pairs of parallel arms; and a spray nozzle mounted on said articulated frame and arranged to spray a water jet against each log passed through said ring member, wherein said spray nozzle is arranged so as to maintain a substantially constant distance from the log.

2. An apparatus as claimed in claim 1, wherein said ring member is rotatable about said central axis, the apparatus further comprising means for rotatably oscillating said ring member about said central axis thereof.

3. An apparatus as claimed in claim 1, wherein said spray nozzle is mounted on said intermediate arm.

4. An apparatus as claimed in claim 1, wherein a radial position of said spray nozzle can be adjusted.

5. An apparatus according to claim 1, wherein at least one arm of said first and second pairs of parallel arms is provided with a follower on a second end thereof, opposite said first end of said at least one arm pivotably connected to said ring member, said follower being constructed and arranged to contact and follow the surface of the log.

6. An apparatus according to claim 1, wherein a position of said ring member is adjustable such that said central axis of said ring member can be made to substantially coincide with an axis of a log being passed therethrough.

7. An apparatus according to claim 1, wherein said arms of said first and second pairs of parallel arms are interconnected by first and second transverse bars, respectively.

8. An apparatus according to claim 7, wherein said intermediate arm is pivotably connected to said first and second transverse bars, respectively.

9. An apparatus according to claim 5, wherein said follower is biased in a radially inward direction, relative to said ring member.

10. An apparatus according to claim 1, wherein said first and second pairs of parallel arms are oriented relative to one another along a direction parallel to said central axis of said ring member.

11. An apparatus according to claim 1, wherein four said spray units are mounted on said ring member.

12. An apparatus according to claim 1, wherein said plurality of spray units are constructed and arranged to be selectively movable.

13. An apparatus according to claim 12, wherein said plurality of spray units are selectively movable in a radial direction relative to said ring member.

14. An apparatus according to claim 13, further comprising means for controlling said selective movement of said plurality of spray units.

15. An apparatus according to claim 14, wherein said means for controlling is operable to cause said plurality of spray units to move inwardly and outwardly in correspondence with the passing of the log through the ring member.

16. An apparatus according to claim 1, wherein said plurality of spray units mounted on said ring member are located at regular intervals therearound.

* * * * *